US008956244B1

(12) United States Patent
Westrum et al.

(10) Patent No.: US 8,956,244 B1
(45) Date of Patent: Feb. 17, 2015

(54) GOLF CLUB HEAD WITH CENTER OF GRAVITY ADJUSTABILITY

(71) Applicant: Callaway Golf Company, Carlsbad, CA (US)

(72) Inventors: Joshua D. Westrum, Vista, CA (US); James E. Seluga, Carlsbad, CA (US); Patrick Dawson, San Diego, CA (US); Sean P. Griffin, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 53 days.

(21) Appl. No.: 13/906,572

(22) Filed: May 31, 2013

Related U.S. Application Data

(63) Continuation-in-part of application No. 13/797,404, filed on Mar. 12, 2013.

(60) Provisional application No. 61/657,247, filed on Jun. 8, 2012, provisional application No. 61/665,203, filed on Jun. 27, 2012, provisional application No. 61/684,079, filed on Aug. 16, 2012.

(51) Int. Cl.
*A63B 53/06* (2006.01)

(52) U.S. Cl.
USPC ..... 473/338; 473/345

(58) Field of Classification Search
USPC ..... 473/334–339, 345
See application file for complete search history.

(56) References Cited

U.S. PATENT DOCUMENTS

| | | | | |
|---|---|---|---|---|
| 5,489,097 | A | 2/1996 | Simmons | |
| 5,967,904 | A * | 10/1999 | Nagai et al. | 473/345 |
| 6,106,412 | A * | 8/2000 | Kosugi et al. | 473/305 |
| 6,149,533 | A | 11/2000 | Finn | |
| 6,875,126 | B2 * | 4/2005 | Yabu | 473/305 |
| 6,923,734 | B2 | 8/2005 | Meyer | |
| 7,108,609 | B2 | 9/2006 | Stites et al. | |
| 7,351,161 | B2 | 4/2008 | Beach | |
| 7,445,563 | B1 * | 11/2008 | Werner | 473/332 |
| 7,497,787 | B2 * | 3/2009 | Murphy et al. | 473/329 |
| 7,691,006 | B1 | 4/2010 | Burke | |
| 7,775,905 | B2 | 8/2010 | Beach et al. | |
| 7,914,393 | B2 | 3/2011 | Hirsch et al. | |
| 7,927,231 | B2 | 4/2011 | Sato et al. | |
| 8,523,702 | B2 * | 9/2013 | Thomas et al. | 473/322 |
| 8,591,352 | B2 * | 11/2013 | Hirano | 473/336 |
| 2003/0087709 | A1 * | 5/2003 | McCabe | 473/305 |
| 2004/0204264 | A1 * | 10/2004 | Matsunaga et al. | 473/345 |
| 2007/0149315 | A1 * | 6/2007 | Bennett et al. | 473/334 |
| 2008/0146375 | A1 * | 6/2008 | Nakano | 473/350 |
| 2010/0273565 | A1 | 10/2010 | Stites et al. | |

(Continued)

FOREIGN PATENT DOCUMENTS

JP 2011125623 A * 6/2011

*Primary Examiner* — Stephen L. Blau

(74) *Attorney, Agent, or Firm* — Rebecca Hanovice; Michael A. Catania; Sonia Lari

(57) ABSTRACT

A golf club head comprising an adjustable weighting feature including a tube extending from the crown to the sole of the golf club head is disclosed herein. More specifically, a golf club head formed from three pieces, namely a first piece comprising a face, a crown portion, a sole portion, and a hosel, a second piece comprising a rear end, a crown portion, and a sole portion, and a tube, wherein these pieces are welded to one another, is disclosed herein. Each of these pieces may be separately cast, forged, or formed from a metal material such as stainless steel, titanium alloy, and aluminum alloy.

13 Claims, 10 Drawing Sheets

(56) References Cited

U.S. PATENT DOCUMENTS

| | | | | |
|---|---|---|---|---|
| 2010/0304887 | A1 | 12/2010 | Bennett et al. | |
| 2011/0039632 | A1* | 2/2011 | Bennett et al. | 473/328 |
| 2011/0039634 | A1 | 2/2011 | Tavares et al. | |
| 2011/0152001 | A1 | 6/2011 | Hirano | |
| 2011/0172027 | A1* | 7/2011 | Hirsch et al. | 473/332 |
| 2011/0224017 | A1 | 9/2011 | Thomas et al. | |
| 2012/0094780 | A1 | 4/2012 | Slaughter et al. | |
| 2012/0165115 | A1 | 6/2012 | Matsunaga | |
| 2012/0302367 | A1 | 11/2012 | Myrhum et al. | |
| 2013/0102410 | A1* | 4/2013 | Stites et al. | 473/335 |
| 2013/0130829 | A1* | 5/2013 | Bennett et al. | 473/337 |
| 2013/0184099 | A1* | 7/2013 | Stites et al. | 473/338 |
| 2013/0190103 | A1* | 7/2013 | Rice et al. | 473/334 |
| 2014/0004972 | A1* | 1/2014 | Thomas et al. | 473/332 |

* cited by examiner

GOLF CLUB HEAD WITH CENTER OF GRAVITY ADJUSTABILITY

CROSS REFERENCES TO RELATED APPLICATIONS

The present application is a continuation-in-part of U.S. patent application Ser. No. 13/797,404, filed on Mar. 12, 2013, which claims priority to U.S. Provisional Patent Application No. 61/657,247, filed on Jun. 8, 2012, U.S. Provisional Patent Application No. 61/665,203, filed on Jun. 27, 2012, and U.S. Patent Application No. 61/684,079, filed on Aug. 16, 2012, the disclosure of each of which is hereby incorporated in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head comprising a center of gravity height adjustability assembly.

2. Description of the Related Art

The prior art discloses various designs with center of gravity adjustments to improve golf club performance, but fails to provide a golf club with designs that efficiently alter center of gravity parameters and consequentially enable the golf club to be swung faster along its path and contribute to an improved impact event with the golf ball.

The United States Golf Association (USGA) has increasingly limited the performance innovations of golf clubs, particularly drivers. Recently, the USGA has limited the volume, dimensions of the head, such as length, width, and height, face compliance, inertia of driver heads and overall club length. Current methods previously used to improve the performance of a driver have been curtailed by limitations on design parameters set by the USGA. An area of driver performance improvement that exists, as of this date, is the potential to adjust the height of the center of gravity. A change in height of the center of gravity would allow the driver club head to travel faster along its path and contribute to an improved impact event with the golf ball, resulting in higher golf ball velocities and consequentially, in longer golf shots.

The purpose of this invention is to effectively incorporate several design features in the golf club head that will enable adjustment of the height of the center of gravity. The recent past has shown that driver designs have trended to include characteristics to increase the driver's inertia values to help off-center hits go farther and straighter. Driver designs have also recently included larger faces, which may help the driver deliver better-feeling shots as well as shots that have higher ball speeds if hit away from the face center. However, these recent trends may also be detrimental to the driver's performance due to the head speed reductions that these design features introduce due to the larger geometries. The design of the present invention allows for higher inertias and robust face design of current drivers in addition to a golf club head design wherein the center of gravity is adjustable.

BRIEF SUMMARY OF THE INVENTION

The main objective of the present invention is to improve the location of the height of the center of gravity. To improve the height of the center of gravity, a golf club head is created which has center of gravity height adjustment assembly. This multiple designs enabling adjustment of the center of gravity can affect the moment of inertial and ultimately the forgiveness of the golf club head.

One aspect of the golf club head of the present invention comprises a body having a crown, a sole, a face and a hosel, wherein the body defines a hollow interior; and a center of gravity height adjustment assembly wherein the center of gravity height adjustment assembly is positioned within the hollow interior of the body. Preferably, the center of gravity of the golf club head can be adjusted along at least one axis by approximately 0.050 inch to 0.100 inch.

Another aspect of the present invention is a golf club head comprising a hollow first piece comprising a face, a first crown portion, a first sole portion, and a hosel, a hollow second piece comprising a second crown portion, a second sole portion, and a rear end, and a tube, wherein at least one of the first piece and the second piece comprises a cutout sized to receive at least part of the tube, wherein the tube is permanently affixed to at least one of the first piece and the second piece within the cutout, wherein the first piece is permanently affixed to the second piece, wherein the tube extends from the sole to the crown, and wherein at least a portion of the golf club head interior is hollow. Though the tube may be solid, in some embodiments, the tube may be hollow and may comprise an upper opening and a lower opening.

In some embodiments, each of the first piece, second piece, and tube may be composed of a metal material, the tube may be welded to at least one of the first piece and the second piece within the cutout, and the first piece may be welded to the second piece. In other embodiments, each of the first piece and the second piece may comprise an opening sized to receive at least part of the tube, the tube may be cylindrical, and each opening may also be semicircular. Some embodiments may further comprise a cover, which may be disposed on the crown and may close the upper opening of the tube. In further embodiments, the cover may be integrally formed with one of the first crown piece and the second crown piece.

In some other embodiments, the golf club head may further comprise a carrier, which may be sized to fit through the lower opening of the tube and within the hollow interior of the tube. The carrier may comprise a first material and a second material, and the specific gravity of the first material may be less than the specific gravity of the second material. In some embodiments, the first material may be located at a first end of the carrier, the second material may be located at a second end of the carrier, and changing the orientation of the carrier within the tube may adjust the location of the center of gravity of the golf club head along a vertical Z axis. In further embodiments, changing the orientation of the carrier may change the location of the golf club head center of gravity by no less than 0.050 inch and no more than 0.100 inch, and more preferably by 0.070 inch. The golf club head may further comprise a cap, which may close the lower opening of the tube and may be removably affixed to the sole of the golf club head.

In some embodiments, each of the first piece and the second piece may comprise approximately 50% of the golf club head, while in alternative embodiments, the first piece may comprise approximately 20% of the golf club head. In some embodiments, the metal material may selected from the group consisting of stainless steel and titanium alloy, while the tube may be composed of a more lightweight material, such as plastic, composite, aluminum, or magnesium.

Another aspect of the present invention is a wood-type golf club head comprising a first piece composed of a first metal material and comprising a face, a first crown portion, a first sole portion, and a hosel, a second piece composed of a second metal material and comprising a second crown portion, a second sole portion, and a rear end, and a tube composed of a third metal material, wherein at least one of the first piece and the second piece comprises a cutout sized to receive at least part of the tube, wherein the tube is welded to at least one of the first piece and the second piece within the cutout, wherein the first piece is welded to the second piece, wherein the tube extends from the sole to the crown, and wherein at least a portion of the golf club head interior is hollow. In some embodiments, each of the first piece and the second piece may be made using a manufacturing method selected from the group consisting of casting, forging, and sheet metal forming. In some embodiments, each of the first, second, and third metal materials may be a stainless steel material, while in other embodiments, each of the first, second, and third metal materials may differ from each other in at least one property.

Yet another aspect of the present invention is a method of manufacturing a golf club head, the method comprising the steps of casting from a first metal material a first piece of the golf club head having a face, a hosel, a first crown portion, a first sole portion, and a first hollow interior, casting from a second metal material a second piece of the golf club head having a second crown portion, a second sole portion, a rear end, and a second hollow interior, casting from a third metal material a hollow tube having an upper opening and a lower opening, welding the hollow tube within one of the first hollow interior and the second hollow interior, and welding the first piece to the second piece to enclose the tube within the golf club head. In some embodiments, each of the first, second, and third metal materials may be a stainless steel material. In other embodiments, each of the first crown portion, the second crown portion, the first sole portion, and the second sole portion may comprise an opening sized to receive at least a portion of the tube, the tube may be welded to the first piece, and at least the lower opening of the tube may be accessible when the first piece is welded to the second piece.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
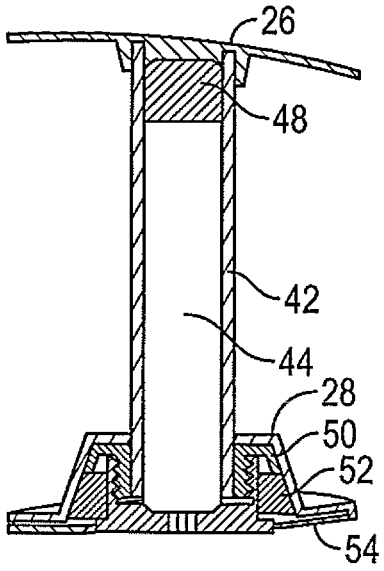
FIG. 1 is a cross sectional view of a golf club head comprising a first embodiment of a center of gravity height adjustment assembly.

The present invention relates to the design of a golf club head 20 having a body 22, the body having a crown 26, a sole 28, a face 30 and a hosel 32, wherein the body 22 defines a hollow interior 24, and a center of gravity height adjustment assembly 40. The center of gravity height adjustment assembly 40 is positioned within the hollow interior 24 of the body 22. Preferably the center of gravity of the golf club head 20 can be adjusted in a vertical direction by at least approximately 0.050 inch, more preferably at least approximately 0.070, and most preferably at least approximately 0.100 inch. The golf club head 20 of the present invention may be any type of golf club head, but more preferably is a wood such as a driver, a fairway wood, or a hybrid.

As shown in FIG. 1, in one embodiment of the present invention, the golf club head 20 of the present invention is a driver-type club head 20 having a center of gravity height adjustment assembly 40 comprising a tube 42 and a carrier 44. Preferably, the tube 42 is composed of a carbon material with an approximate mass ranging from 3.50 to 4.50 grams, and more preferably approximately 4.02 grams. The carrier 44 is preferably composed of a urethane material with an approximate mass ranging from 3.50 grams to 4.50 grams, and more preferably approximately 3.91 grams. Preferably, the tube 42 extends from the crown 26 to the sole 28, and the distance between the crown 26 to the sole 28 is less than 3.8 inches. The carrier 44 comprises a first material 46(*a*) and a second material 46(*b*), wherein the specific gravity of the first material 46(*a*) is less than the specific gravity of the second material 46(*b*). The center of gravity height adjustment assembly 40 further comprises a slug 48, the slug 48 preferably composed of tungsten and having a mass ranging from 9.0 to 10.0 grams, and more preferably approximately 9.42 grams. The center of gravity height adjustment assembly 40 may further comprise a cap 52, with an approximate weight of 4.65 grams and a cap nutplate 50 with an approximate weight 1.70 to 3.0 grams, and more preferably of 2.86 grams. The center of gravity height adjustment assembly further comprises a skid plate 54 with an approximate weight of 2.40 to 2.90 grams, and more preferably approximately 2.82 grams.

In the preferred embodiment, the center of gravity height adjustment assembly 40 comprises a tube 42 having a mass of approximately 4.00 grams, a carrier 44 having a mass of approximately 3.90 grams, a slug 48 having a mass of approximately 9.40 grams, a cap 52 having a mass of approximately 4.65 grams, a cap nutplate 50 having a mass of approximately 2.86 grams, and a skid plate 54 having a mass of approximately 2.82 grams. Preferably, the driver type golf club head 20 has a volume of less than 400 cubic centimeters, and the body 22 of the club head 20 is composed of a stainless steel material. In another embodiment, the sole 28 is composed of a metal material and the crown 26 is composed of a non-metal material. Alternatively, the body 22 is composed of a titanium alloy material.

Figure 2:
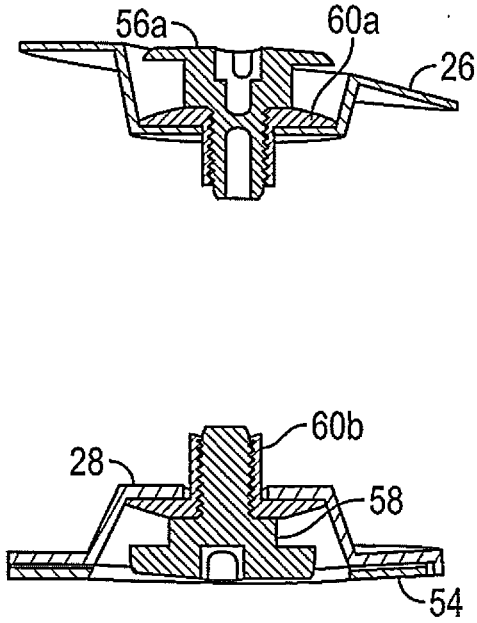
FIG. 2 is a cross sectional view of a golf club head comprising a second embodiment of a center of gravity height adjustment assembly.

As shown in FIG. 2, in a second embodiment, the center of gravity height adjustment assembly 40 comprises a first weight screw 56(*a*) and a second weight screw 56)*b*). Preferably first weight screw 56(*a*) has a mass with an approximate range of 9.50 grams to 10.50 grams. The second weight screw 56(*b*) has a range of mass of approximately 2.0 grams to 3.00 grams. The center of gravity height adjustment assembly 40 may further comprise a skid plate 54 and two nutplates (60(*a*) and 60(*b*)). In a preferred embodiment, the first weight screw 56(*a*) has a mass of approximately 10.30 grams, the second weight screw 56(*b*) has a mass of approximately 2.50 grams, the skid plate 54 has a mass of approximately 2.70 grams, and each of the nutplates (60(*a*) and 60(*b*)) have a mass of approximately 2.00 grams. Ideally, the crown 26 of the golf club head comprising the center of gravity adjustment assembly 40 has a mass of approximately 2.85 grams when composed of carbon. The sole 28 of the golf club head comprising the center of gravity adjustment assembly 40 has a mass of approximately 2.78 grams when composed of carbon.

Figure 3:
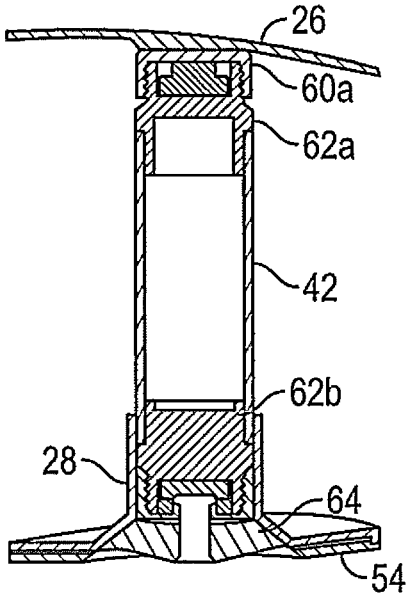
FIG. 3 is a cross sectional view of a golf club head comprising a third embodiment of a center of gravity height adjustment assembly.

As shown in FIG. 3, in a third embodiment of the center of gravity height adjustment assembly 40, the assembly 40 comprises a tube 42 and at least two weight pieces (62(*a*) and 62(*b*)). Preferably, the mass of the tube 42 ranges from 2.00 grams to 3.00 grams. Preferably, the mass of one of the at least two weight pieces (62(*a*) and 62(*b*)) is approximately 2.50 grams and the mass of the other at least two weight pieces (62(*a*) and 62(*b*)) is approximately 10.00 grams. The center of gravity height adjustment assembly 40 may further comprise a skid plate 54, a cap screw 64 and a nutplate 60(*a*). In a preferred embodiment, the skid plate 54 has a mass of roughly 2.83 grams, the cap screw 64 has a mass of approximately 7.22 grams and the nutplate 60(*a*) has a mass of 1.41 grams. Preferably, the tube 42 has a mass of approximately 2.40 grams. Ideally, the crown 26 of the golf club head 20 comprising the center of gravity adjustment assembly 40 has a mass of approximately 2.53 grams when composed of carbon. The sole 28 of the golf club head 20 comprising the center of gravity adjustment assembly 40 has a mass of approximately 3.05 grams when composed of carbon.

Figure 4:
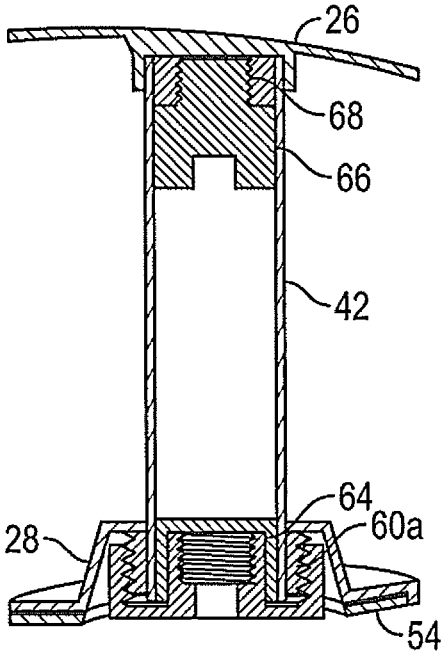
FIG. 4 is a cross sectional view of a golf club head comprising a fourth embodiment of a center of gravity height adjustment assembly.

As shown in FIG. 4, in a fourth embodiment, the center of gravity height adjustment assembly 40 comprises a tube 42, a weight screw 66 and a cap screw 64. The mass of the tube 42 is approximately between 3.00 grams and 4.00 grams. The mass of the weight screw 66 is approximately between 9.50 grams and 10.50 grams. Preferably, the mass of the cap screw 64 is between approximately 4.00 grams and 5.00 grams. Ideally, the mass of the tube 42 is 3.54 grams, the mass of the weight screw 66 is roughly 10.00 grams and the mass of the cap screw 64 is approximately 4.58 grams. The center of gravity height adjustment assembly 40 may further comprise a nut 68, a nutplate 60(*a*) and a skid plate 54. Preferably, the skid plate 54 has a mass of approximately 2.45 grams, the nut 68 has a mass of approximately 1.22 grams and the nutplate 60(*a*) has a mass of approximately 1.72 grams. Ideally, the crown 26 of the golf club head comprising 20 the center of gravity adjustment assembly 40 has a mass of approximately 3.08 grams when composed of carbon. The sole 28 of the golf club head 20 comprising the center of gravity adjustment assembly 40 has a mass of approximately 2.78 grams when composed of carbon.

A preferred design for a golf club head with at least two mass elements is found using the following equation:

$$D \geq 0.065(1+M/(M_b-M_a))$$

wherein D equals the distance between the two mass elements, M equals the mass of the golf club head, $M_b$ equals the mass of weighting element B, and M, equals the mass of weighting element A. A more preferred D is:

$$D \geq 0.095(1+M/(M_b-M_a))$$

Figure 12:
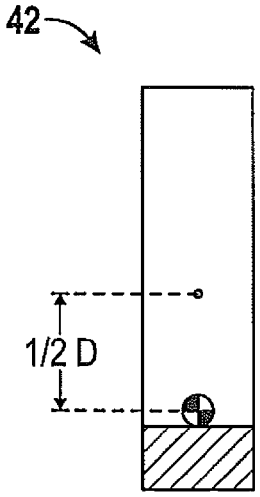
FIG. 12 is a side perspective view of the center of gravity height adjustment assembly comprising a tube wherein the distance from the midpoint of the tube to the center of gravity is shown.
Figure 13:
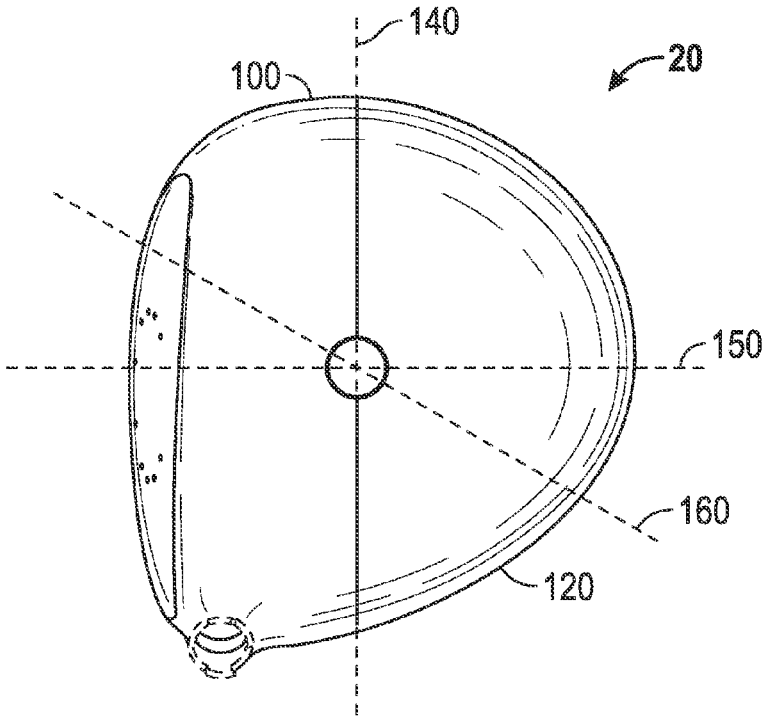
FIG. 13 is a top plan view of another embodiment of the golf club head comprising a tube.
Figure 14:
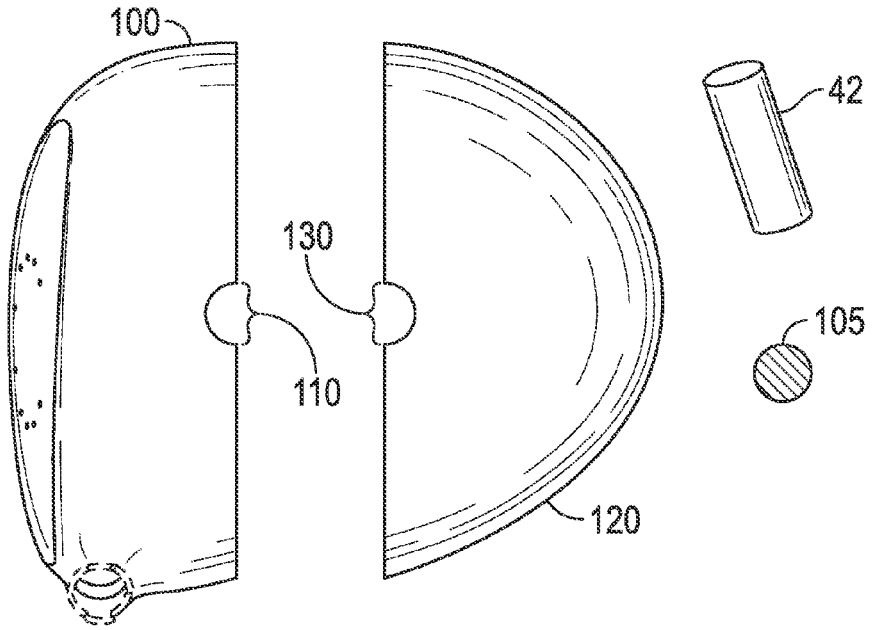
FIG. 14 is an exploded view of the embodiment shown in FIG. 13.

Determining the preferred design for a golf club head incorporating a center of gravity height adjustment assembly comprising a tube is shown as:

$$D \geq 0.065(1+M/(M_t))$$

wherein $M_t$ is the mass of the tube and ½ D is the distance from the midpoint of the tube to the center of gravity, wherein the heavy end of the mass is closer to the sole of the golf club head. This distance is shown in FIG. 12.

Figure 6:
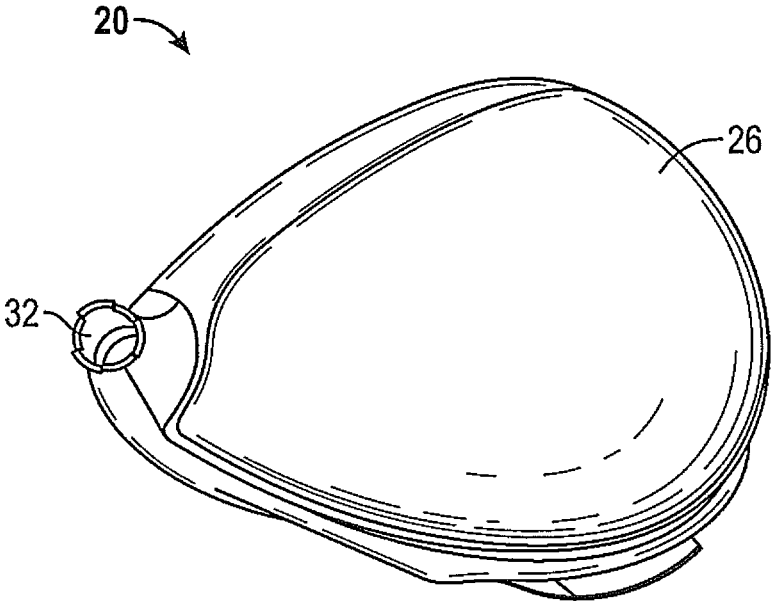
FIG. 6 is a top perspective view of a golf club head.
Figure 7:
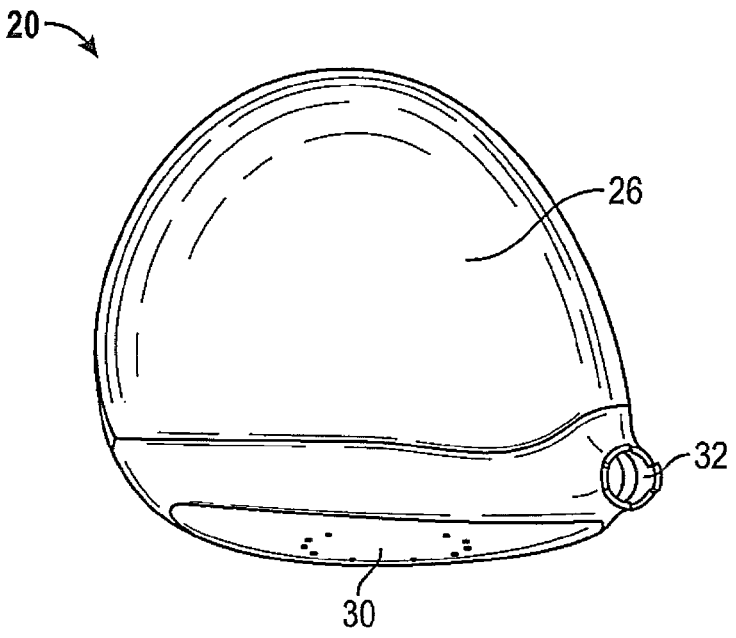
FIG. 7 is a top plan view of a golf club head.
Figure 8:
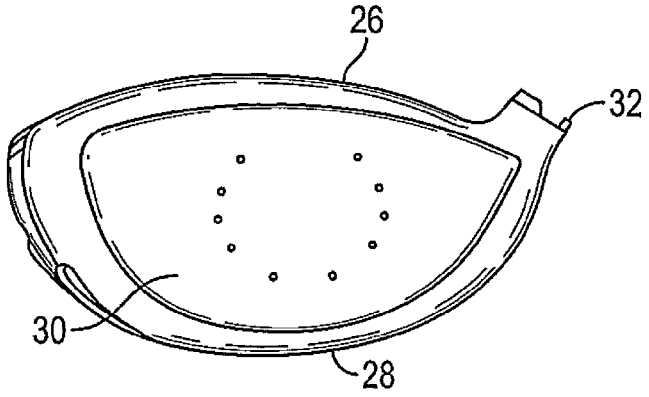
FIG. 8 is a front elevation view of a golf club head.
Figure 9:
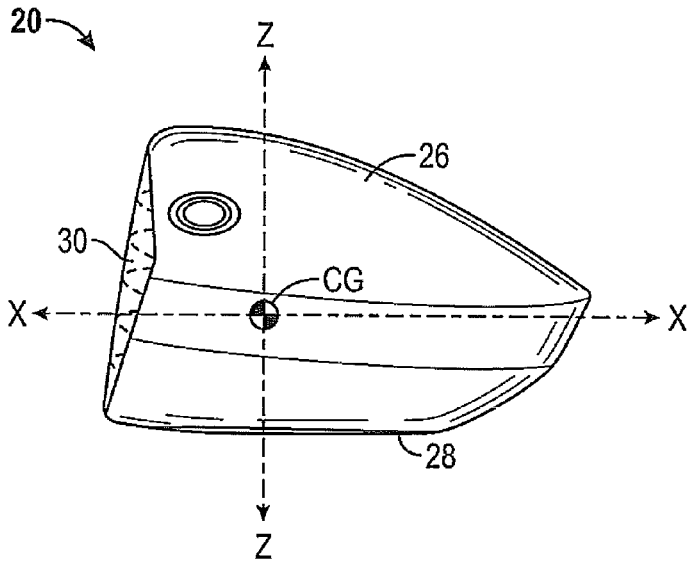
FIG. 9 is a heel side plan view of a golf club head of the present invention illustrating the Z and X axis.
Figure 10:
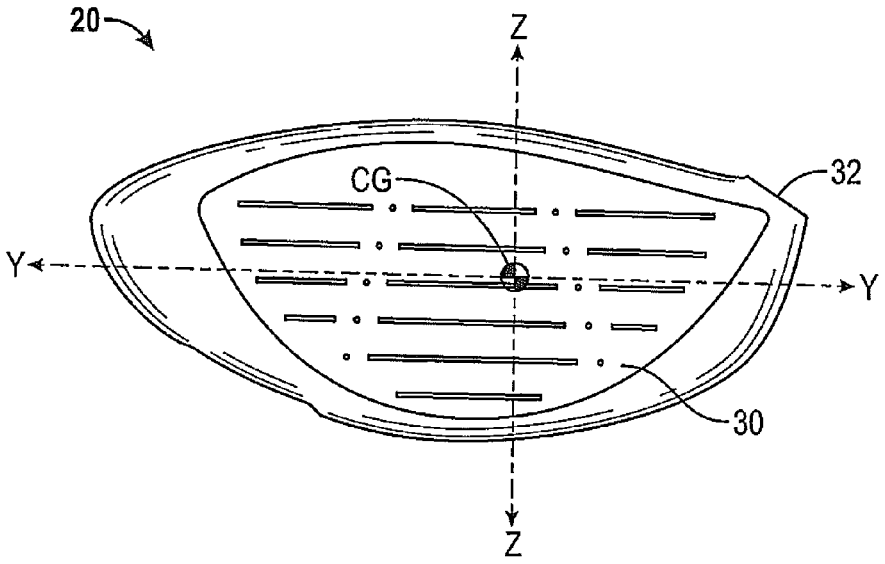
FIG. 10 is a front plan view of a golf club head of the present invention illustrating the Z axis and Y axis.
Figure 11:
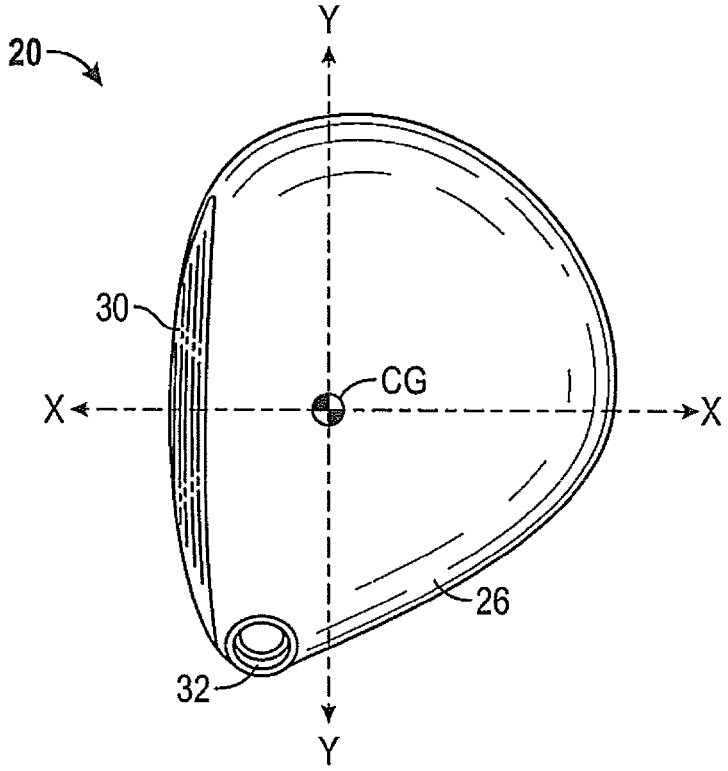
FIG. 11 is a top plan view of a golf club head of the present invention illustrating the X axis and Y axis.

FIGS. 6-8 show the top perspective, top plan and front elevation views of a golf club head of the present invention, while FIGS. 9-11 illustrate the axes of inertia through the center of gravity of the golf club head. The axes of inertia are designated X, Y and Z. The X axis extends from the face of the golf club head through the center of gravity, CG, and to the rear of the golf club head. The Y axis extends from the heel end of the golf club head, through the center of gravity, CG, and to the toe end of the golf club head. The Z axis extends from the sole through the center of gravity, CG, and to the crown. According to the embodiments disclosed herein, the center of gravity height adjustment assembly is located within the hollow structure of the golf club head, in a crown to sole direction, running parallel to the tangent vector of the face. The center of gravity height adjustment preferably occurs in the Z axis plane.

Each of the embodiments of the present invention are may be a driver, fairway wood, or hybrid type golf club head 20 having a volume of less than 400 cubic centimeters, and each may have a body 22 composed of a metal material such as titanium or stainless steel. Alternatively, the embodiments shown herein may have a sole 28 composed of a metal material and a crown 26 composed of a non-metal material.

In yet another alternative embodiment, the golf club head 20 (which may be a driver, fairway wood, or hybrid) may comprise a body 22 having a crown 26 composed of a carbon material, a sole 28 composed of carbon material, a face 30 and a hosel 32, wherein the body 22 defines a hollow 24 interior and a center of gravity height adjustment assembly 40 wherein the center of gravity height adjustment assembly 40 is positioned within the hollow interior 24 of the body 22 and the center of gravity of the golf club head 20 can be adjusted by at least approximately 0.050 inch, and more preferably by 0.10 inch along one of the X, Y, and Z axes, and more preferably along the Z axis. The mass of the crown 26 composed of a carbon material ranges from approximately 2.25 grams or 2.50 grams to 3.50 grams, the mass of the sole 28 composed of a carbon material ranges from 2.50 grams to 3.50 grams or from 3.0 grams to 4.0 grams. In any of the embodiments disclosed herein, the center of gravity height assembly 40 is positioned within the hollow interior 24 of the body 22 and the center of gravity of the golf club head 20 can be adjusted along the Z axis by at least 0.050 inch and more preferably by and 0.10 inch.

In another embodiment, the golf club head 20 comprises a body 22 having a crown 26 composed of a tungsten material, a sole 28 composed of a composite material, a face 30 and a hosel 32, wherein the body 22 defines a hollow interior 24 and a center of gravity height adjustment assembly 40 is positioned within the hollow interior 24 of the body 22.

In any of the embodiments disclosed herein, at least the tube 42 of the center of gravity height adjustment assembly 40 may be integrally formed, e.g., cast, molded, formed, forged, or otherwise created according to a method known to a person skilled in the art, with one or more other parts of the golf club head 20.

Figure 15:
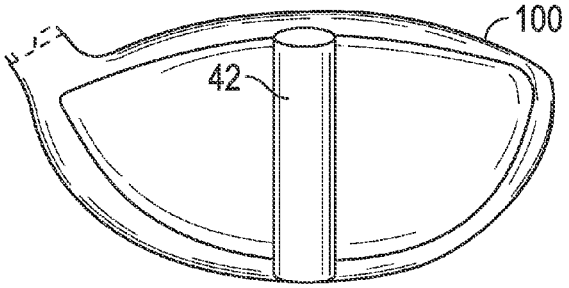
FIG. 15 is a rear, plan view of the front piece of the golf club head shown in FIG. 14.
Figure 16:
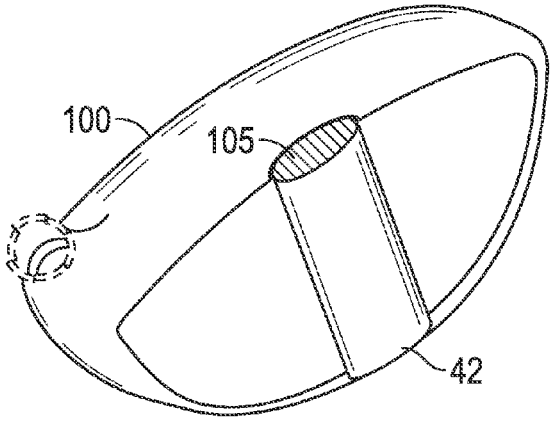
FIG. 16 is a rear, perspective view of the front piece of the golf club head shown in FIG. 15.
Figure 17:
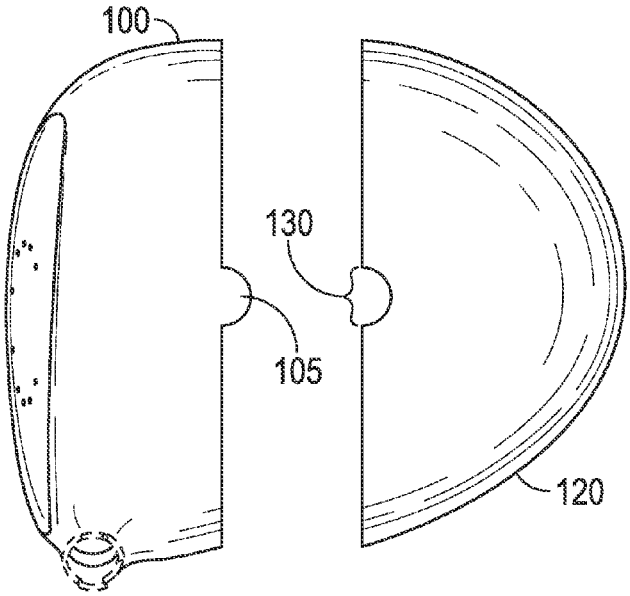
FIG. 17 is an exploded view of another embodiment of the golf club head comprising a tube.

Alternatively, and in the embodiment shown in FIGS. 13-16, the tube 42 extends from the sole 28 to the crown 26 of a wood-type golf club head 20, which is formed from three pieces: a front piece 100 comprising the face 30, the hosel 32, a portion of both the crown 26 and the sole 28, and a first opening or cutout 110 sized to receive the tube 42; the tube 42; and a back piece 120 comprising the remainder of the crown 26, sole 28, and a second opening or cutout 130 sized to receive the tube 42. This configuration allows the tube 42 to be formed and assembled quickly with the rest of the head 20. In particular, the tube 42 is affixed, via welding, soldering, brazing, gluing, or another means known to a person skilled in the art, to one of the two pieces 100, 120, as shown in FIGS. 15 and 16, and then the two pieces 100, 120 are affixed to one another. In some embodiments, each piece 100, 120 of the golf club head 20, as well as the tube 42, is cast from a metal such as titanium or 17-4 stainless steel, and these parts are welded together to form the club head 20. A cover 105, shown in FIGS. 14 and 16, may be added once the club head 20 is assembled to prevent debris from entering into the crown-side opening in the tube 42. The cover 105 may be made of any material, including the same material as one or more pieces of the golf club head 20. In an alternative embodiment, shown in FIG. 17, the cover 105 may be integrally formed with the crown 26 part of at least one of the front piece 100 and rear piece 120, such that the top of the tube 42 is covered once it is welded to that piece 100, 120. In other embodiments, the tube 42 may be formed from a nonmetal material such as composite or plastic, and then may be affixed to one of the pieces 100, 120 of the golf club head via mechanical fasteners or an adhesive, or it may be formed from a lightweight metal alloy such as aluminum or magnesium.

As shown in FIGS. 13-17, each of the front and back pieces 100, 120 of the golf club head 20 make up approximately half of the club head 20, i.e., the head 20 is welded together along a first vertical plane 140 that extends parallel to the face 30 across a midsection or center of the golf club head 20. In alternative embodiments, the club head 20 may be assembled along a second vertical plane 150 that extends perpendicular to the face 30, or along a third vertical plane 160 that extends at an angle between 0 and 90 degrees, and most preferably 45 degrees, with respect to the face 30. In some embodiments, each of the front and back pieces 100, 120 may compose approximately one half of the total golf club head, as shown in FIGS. 13-17, though in other embodiments, one of the front and back pieces 100, 120 may be larger than the other. In one embodiment, the front piece 100 comprises approximately 20% of the golf club head size, such that the tube is disposed closer to the face 30 than in the embodiment shown in FIGS. 13-17. Though the tube 42 preferably is hollow, in some embodiments it may be a solid cylinder to further affect the weight distribution of the golf club head.

Figure 18:
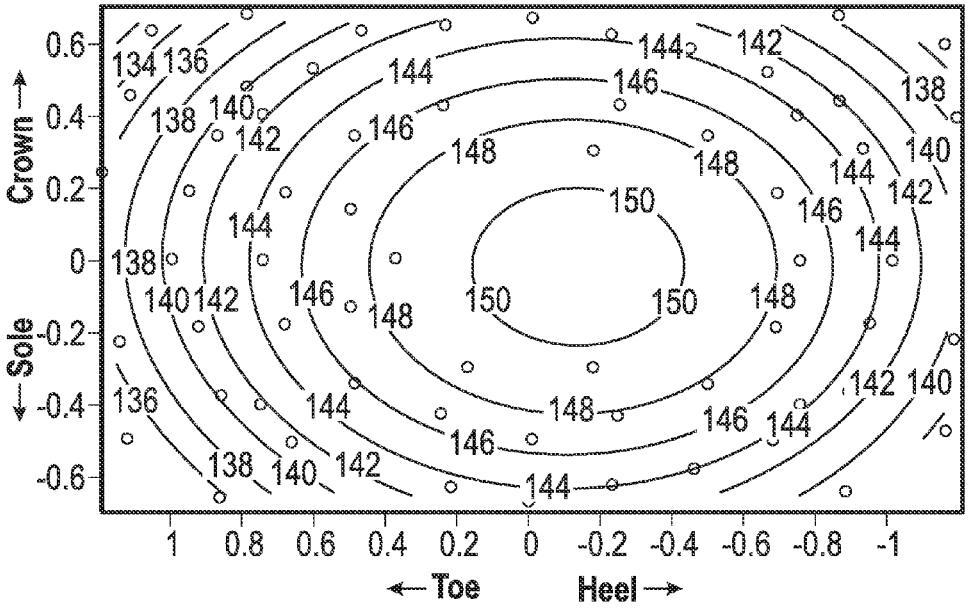
FIG. 18 is face map of a traditional golf club head showing ball speeds across the face.
Figure 19:
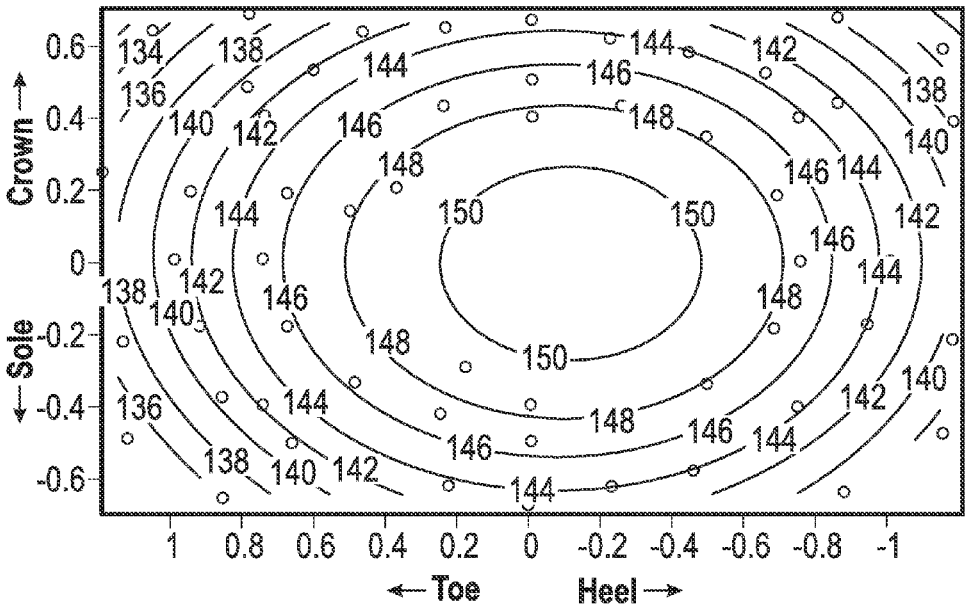
FIG. 19 is a face map of the golf club head shown in FIG. 5 showing ball speeds across the face.
Figure 20:
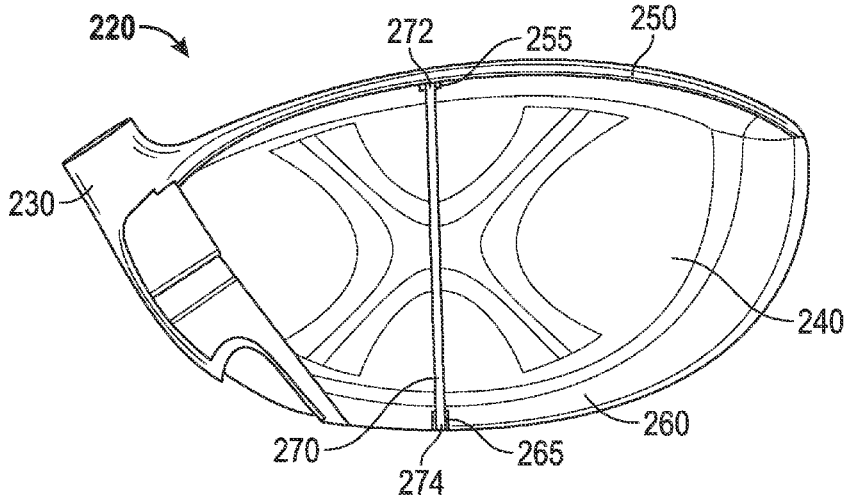
FIG. 20 is a rear perspective view of a face cup for a golf club head comprising a thin bar proximate the face.
Figure 21:
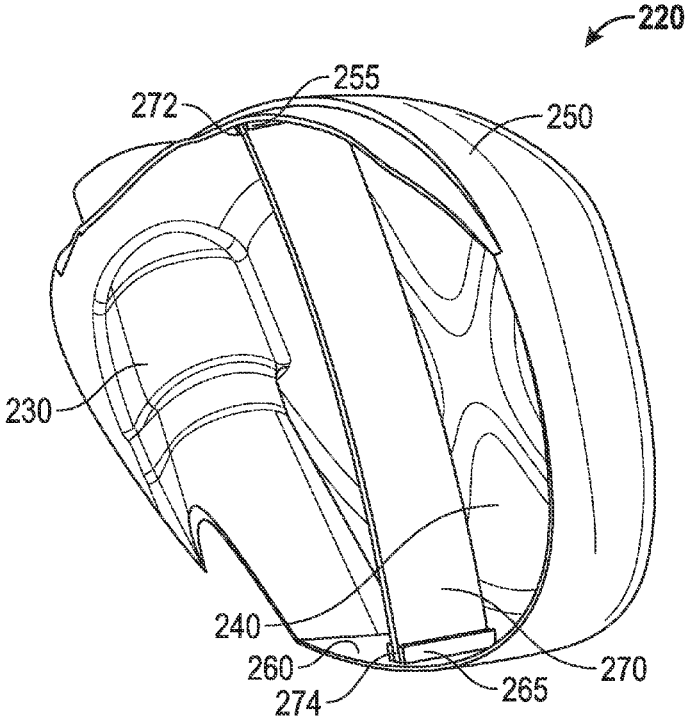
FIG. 21 is a side perspective view of the embodiment shown in FIG. 20.

In each of the embodiments disclosed herein, the presence of the height adjustment assembly 40, and the tube 42 in particular, has a positive effect on the sound and feel of the golf club head 20 during performance, and also improves the performance of the face by distributing the stresses of a ball strike across the club head 20. In particular, the tube 42 provides enough structural support to allow the golf club head 20 to have a very thin face with scorelines, while at the same time providing both improved ball speed and a higher CT, particularly in fairway woods. The graphs shown in FIGS. 18 and 19 illustrate the difference in ball speed caused by a traditional golf club head (FIG. 18) and the golf club head of the present invention shown in FIG. 5, which includes a tube 42 proximate the face 30 (FIG. 19). As illustrated by FIGS. 18 and 19, the presence of the tube 42 increases the size of the sweet spot on the face 30, in that the area of the face where ball speed is greater than 147 mph increases in size by 60% with the inclusion of a tube 42.

Figure 5:
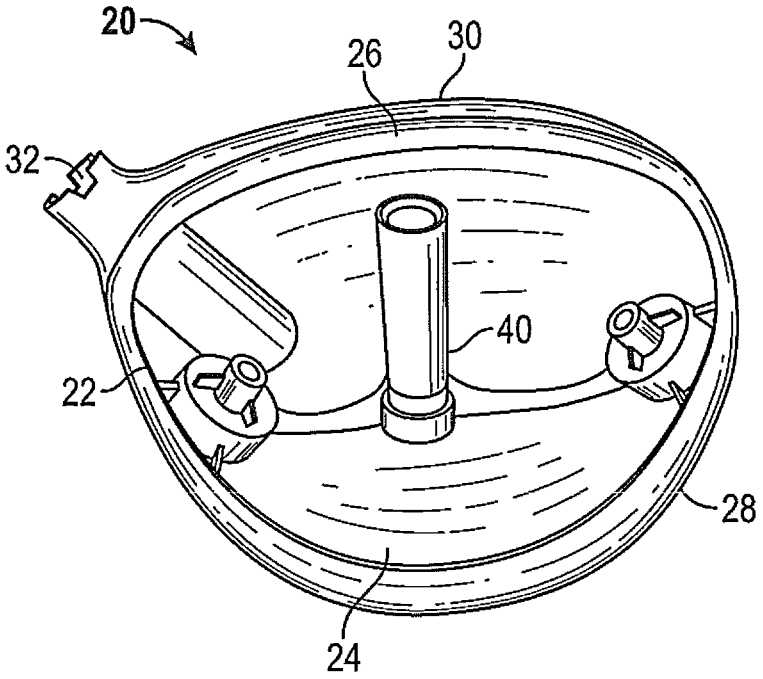
FIG. 5 is a perspective view of a golf club head with the crown removed to show the location of a center of gravity height adjustment assembly.

The tube 42 also increases the stiffness of the sole 28, and thus reduces the sound made by the sole 28 when the golf club head 20 strikes a golf ball, particularly when the tube 42 is disposed proximate the face 30 of the club head 20. The sole 28 has a sound mode that is split into a higher frequency mode and a lower frequency mode, both of which have lower amplitudes when a tube 42 is located proximate the face 30 as shown in FIG. 5. Tables 1 and 2 show sound measurements taken at three points on a traditional golf club head and the golf club head 20 shown in FIG. 5.

TABLE 1

| | MODE | | | | | |
|---|---|---|---|---|---|---|
| | | sole | | | | face |
| Traditional Golf Club Head | | | | | | |
| frequency (Hz) | | | A | 2810 | B | 3940 (baseline) |
| Amplitude (dB) | | | | 109 | | 104 (baseline) |
| FIG. 5 | | | | | | |
| frequency (Hz) | 1 | 2520 | 2 | 3100 | 3 | 4010 |
| Amplitude (dB) | | 96.1 | | 97.9 | | 102 |

TABLE 2

| | MODE | | | | | |
|---|---|---|---|---|---|---|
| | | sole | | | | face |
| Traditional Golf Club Head | | | | | | |
| frequency (Hz) | | | A | 71% | B | 100% (baseline) |
| Amplitude (dB) | | | | 105% | | 100% (baseline) |
| FIG. 5 | | | | | | |
| frequency (Hz) | 1 | 64% | 2 | 79% | 3 | 102% |
| Amplitude (dB) | | 92% | | 94% | | 98% |

As shown in Tables 1 and 2, the golf club head 20 of the present invention, specifically the embodiment shown in FIG. 5, minimizes sole 28 amplitude (dB) compared to the traditional golf club head construction, while keeping face 30 amplitude within a desired range of approximately 3000 to 4000 Hz, and while remaining at the highest amplitude in the system. The presence of the tube 42 thus improves the overall sound quality and durability of the club head 20, which allows for the use of cheaper metals and cheaper manufacturing processes.

In an alternative embodiment, a thin bar instead of using a tube 42 can be used connect the crown and sole, as shown in FIGS. 22 and 23. As shown in these Figures, a golf club face cup 220 is provided. The face cup 220 includes a hosel 230, a face 240, a crown portion 250, and a sole portion 260. Each of the crown and sole portions 250, 260 has an alignment feature 255, 265, and each of the upper and lower ends 272, 274 of a thin bar 270 is retained within each of these alignment features 255, 265 such that the thin bar 270 is located directly behind, but does not touch, the face 240. This configuration provides sound and ball speed benefits similar to those provided by the embodiments of the present invention that incorporate a tube 42 proximate the face 30.

Gibbs, et al., U.S. Pat. No. 7,163,468 is hereby incorporated by reference in its entirety.

Galloway, et al., U.S. Pat. No. 7,163,470 is hereby incorporated by reference in its entirety.

Williams, et al., U.S. Pat. No. 7,166,038 is hereby incorporated by reference in its entirety.

Desmukh U.S. Pat. No. 7,214,143 is hereby incorporated by reference in its entirety.

Murphy, et al., U.S. Pat. No. 7,252,600 is hereby incorporated by reference in its entirety.

Gibbs, et al., U.S. Pat. No. 7,258,626 is hereby incorporated by reference in its entirety.

Galloway, et al., U.S. Pat. No. 7,258,631 is hereby incorporated by reference in its entirety.

Evans, et al., U.S. Pat. No. 7,273,419 is hereby incorporated by reference in its entirety.

Foster, et al., U.S. Pat. No. 8,337,328 is hereby incorporated by reference in its entirety.

Evans, et al., U.S. Pat. No. 8,317,636 is hereby incorporated by reference in its entirety.

Watson, et al., U.S. Pat. No. 8,262,506 is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a hollow first piece comprising a face, a first crown portion, a first sole portion, and a hosel;

a hollow second piece comprising a second crown portion, a second sole portion, and a rear end; and a tube;

wherein at least one of the first piece and the second piece comprises a cutout sized to receive at least part of the tube, wherein the tube is permanently affixed to at least one of the first piece and the second piece within the cutout, wherein the first piece is permanently affixed to the second piece, wherein the tube extends from the sole to the crown, wherein at least a portion of the golf club head interior is hollow, wherein the tube is spaced from the hosel, wherein the tube is inserted in both the first piece and the second piece, wherein the tube is hollow and comprises an upper opening and a lower opening, wherein a cover is integrally formed with one of the first crown portion and the second crown portion, and wherein the cover closes the entire upper opening of the tube.

2. The golf club head of claim 1, further comprising a carrier, wherein the carrier is sized to fit through the lower opening of the tube, wherein the carrier is sized to fit within the hollow interior of the tube, wherein the carrier comprises a first material and a second material, and wherein the specific gravity of the first material is less than the specific gravity of the second material.

3. The golf club head of claim 2, wherein the first material is located at a first end of the carrier, wherein the second material is located at a second end of the carrier, and wherein changing the orientation of the carrier within the tube adjusts the location of the center of gravity of the golf club head along a vertical Z axis.

4. The golf club head of claim 3, wherein changing the orientation of the carrier changes the location of the golf club head center of gravity by no less than 0.050 inch and no more than 0.100 inch.

5. The golf club head of claim 2, further comprising a cap, wherein the cap closes the lower opening of the tube and is removably affixed to the sole of the golf club head.

6. The golf club head of claim 1, wherein each of the first piece, second piece, and tube is composed of a metal material, wherein the tube is welded to at least one of the first piece and the second piece within the cutout, and wherein the first piece is welded to the second piece.

7. The golf club head of claim 6, wherein the metal material is selected from the group consisting of stainless steel and titanium alloy.

8. The golf club head of claim 1, wherein each of the first piece and the second piece comprises approximately 50% of the golf club head.

9. The golf club head of claim 1, wherein the first piece comprises approximately 20% of the golf club head.

10. The golf club head of claim 1, wherein the tube is composed of a composite material.

11. A wood-type golf club head comprising a first piece composed of a first metal material and comprising a face, a first crown portion, a first sole portion, and a hosel;

a second piece composed of a second metal material and comprising a second crown portion, a second sole portion, and a rear end; and a tube composed of a third metal material;

wherein at least one of the first piece and the second piece comprises a cutout sized to receive at least part of the tube, wherein the tube is welded to at least one of the first piece and the second piece within the cutout, wherein the first piece is welded to the second piece, wherein the tube extends from the sole to the crown, wherein at least a portion of the golf club head interior is hollow, wherein the tube is spaced from the hosel, wherein the tube is inserted in both the first piece and the second piece, wherein the tube is hollow and comprises an upper opening and a lower opening, wherein a cover is integrally formed with one of the first crown portion and the second crown portion, and wherein the cover closes the entire upper opening of the tube.

12. The wood-type golf club head of claim 11, wherein each of the first piece and the second piece is made using a manufacturing method selected from the group consisting of casting, forging, and sheet metal forming.

13. The wood-type golf club head of claim 11, wherein each of the first, second, and third metal materials is a stainless steel material.

* * * * *